US011052507B2

(12) United States Patent
Lin

(10) Patent No.: US 11,052,507 B2
(45) Date of Patent: Jul. 6, 2021

(54) AUXILIARY POSITIONING DEVICE OF PEDESTAL GRINDER

(71) Applicant: Kowutsumi Electro. Co., Ltd, Taichung (TW)

(72) Inventor: Shuei-Cheng Lin, Taichung (TW)

(73) Assignee: Kowutsumi Electro. Co., Ltd, Taichung (TW)

( * ) Notice: Subject to any disclaimer, the term of this patent is extended or adjusted under 35 U.S.C. 154(b) by 433 days.

(21) Appl. No.: 16/120,511

(22) Filed: Sep. 4, 2018

(65) Prior Publication Data

US 2020/0070303 A1 Mar. 5, 2020

(51) Int. Cl.
*B24B 41/06* (2012.01)

(52) U.S. Cl.
CPC ..... *B24B 41/06* (2013.01)

(58) Field of Classification Search
CPC ..... B24B 23/005; B24B 23/02; B24B 23/022; B24B 27/02; B24B 27/08; B24B 41/005; B24B 41/06; B24B 41/065; B24B 5/18
USPC ..... 451/231, 241, 282, 340, 361, 364, 405, 451/406, 414, 415, 420, 525, 545, 558; D15/125
See application file for complete search history.

(56) References Cited

U.S. PATENT DOCUMENTS 442,788 A * 12/1890 Visscher ..... B24B 27/065 451/231
1,430,426 A * 9/1922 Zongaro ..... B24B 41/06 451/406
1,823,065 A * 9/1931 Scruby ..... B24B 19/28 451/241
1,949,070 A * 2/1934 Barrett ..... B24B 19/28 451/241
2,169,954 A * 8/1939 King ..... B24B 27/00 451/182
4,156,990 A * 6/1979 Rutkowski ..... B24B 23/02 144/136.95
4,180,358 A * 12/1979 Uribe ..... B23B 5/16 409/179
4,566,511 A * 1/1986 Robinson ..... B23D 57/0076 144/48.5
4,736,545 A * 4/1988 Moss ..... B24B 9/007 409/165

(Continued)

FOREIGN PATENT DOCUMENTS

DE 2826413 A1 * 12/1979 ..... B25H 1/0078

*Primary Examiner* — Joseph J Hail
*Assistant Examiner* — Arman Milanian
(74) *Attorney, Agent, or Firm* — Demian K. Jackson; Jackson IPG PLLC

(57) ABSTRACT

An auxiliary positioning device is secured on a pedestal grinder which contains a transmission seat including a rotatable fixing block, an output shaft, and multiple grinding units. The auxiliary positioning device includes a support unit and at least one movable holding unit, wherein the support unit has a fitting orifice, a locking portion, and at least one coupling orifice. The locking portion has a slot and a locating portion, and a first of multiple screws is inserted through the slot from the locating portion to force the support unit relative to the rotatable fixing block, thus adjusting a tilting angle of the support unit relative to the rotatable fixing block. Two second of the multiple screws are inserted through the at least one coupling orifice so as to lock the at least one movable holding unit, thus positioning a workpiece auxiliarily.

6 Claims, 8 Drawing Sheets

(56) References Cited

U.S. PATENT DOCUMENTS

| | | | | | |
|---|---|---|---|---|---|
| 4,788,797 | A * | 12/1988 | Kane | B23Q 9/0028 | 409/180 |
| 5,136,816 | A * | 8/1992 | Beckingham | A63C 11/06 | 451/282 |
| 6,146,067 | A * | 11/2000 | Owens | B23B 5/168 | 30/122 |
| 8,297,157 | B1 * | 10/2012 | Miller | B23C 3/007 | 82/113 |
| 8,616,938 | B1 * | 12/2013 | Mills | B24B 23/02 | 451/349 |
| 2012/0067190 | A1 * | 3/2012 | Tseng | B26D 3/02 | 83/869 |
| 2015/0290757 | A1 * | 10/2015 | Rieth | B23C 3/122 | 409/179 |

* cited by examiner

AUXILIARY POSITIONING DEVICE OF PEDESTAL GRINDER

FIELD OF THE INVENTION

The present invention relates to an auxiliary positioning device of a pedestal grinder which is capable of adjusting grinding a workpiece at any desired angles.

BACKGROUND OF THE INVENTION

A conventional pedestal grinder contains a base in which a motor is fixed, one or two grinding wheels rotatably connected on the base and driven by the motor to rotate, hence a workpiece is mounted on the one or two grinding wheels so as to be ground or polished.

Since the one or two grinding wheels of the pedestal grinder are fixed, the workpiece is moved by an operator to be ground by the one or two grinding wheels. However, a grinding precision and a surface roughness of the workpiece are not accurate in such a grinding manner. In addition, the workpiece cannot be ground at any desired angles, and the one or two grinding wheels injure the operator easily.

The present invention has arisen to mitigate and/or obviate the afore-described disadvantages.

SUMMARY OF THE INVENTION

The primary aspect of the present invention is to provide an auxiliary positioning device of a pedestal grinder which is capable of adjusting grinding a workpiece at any desired angles. To obtain the above aspect, an auxiliary positioning device is secured on a pedestal grinder, and the pedestal grinder contains: a transmission seat including a rotatable fixing block integrally extending from a side of the transmission seat, an output shaft connected on a center of the rotatable fixing block and driven by a drive unit to rotate, and multiple grinding units disposed on the output shaft by using a first of multiple screws.

The auxiliary positioning device is secured on the rotatable fixing block of the pedestal grinder.

The auxiliary positioning device includes a support unit and at least one movable holding unit, the support unit is connected on the rotatable fixing block so as to rotate along the rotatable fixing block, and the support unit has a fitting orifice, a locking portion, and at least one coupling orifice, wherein the fitting orifice is defined on the support unit and corresponds to the rotatable fixing block.

The locking portion is configured to fix the rotatable fixing block, and the locking portion has a slot and a locating portion, the slot is defined beside a side of the fitting orifice, and a second of multiple screws is inserted through the slot from the locating portion to force the support unit relative to the rotatable fixing block, thus adjusting a tilting angle of the support unit relative to the rotatable fixing block.

DETAILED DESCRIPTION OF THE PREFERRED EMBODIMENTS

Figure 1:
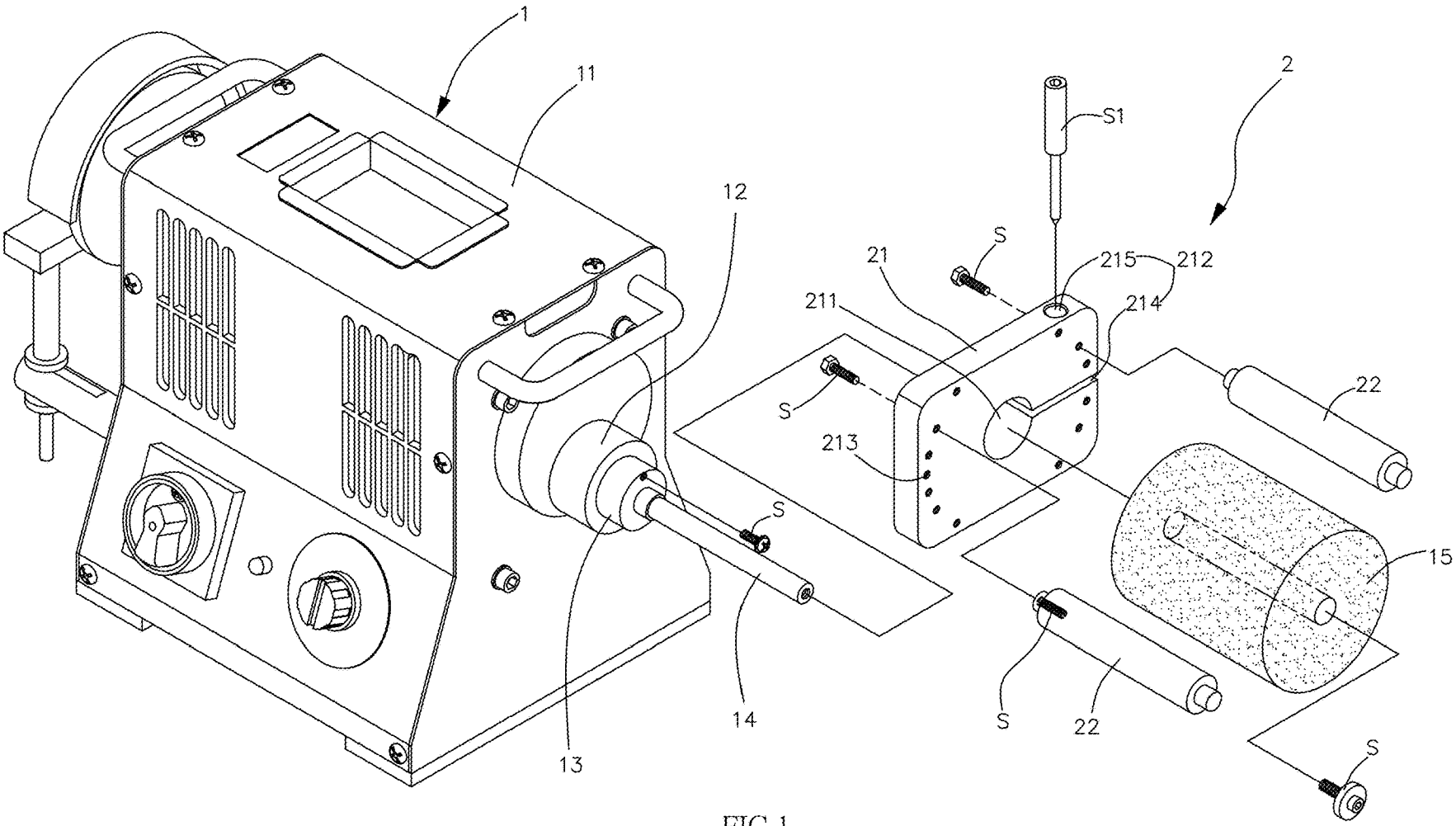
FIG. 1 is a perspective view showing the exploded components of an auxiliary positioning device of a pedestal grinder according to a preferred embodiment of the present invention.
Figure 2:
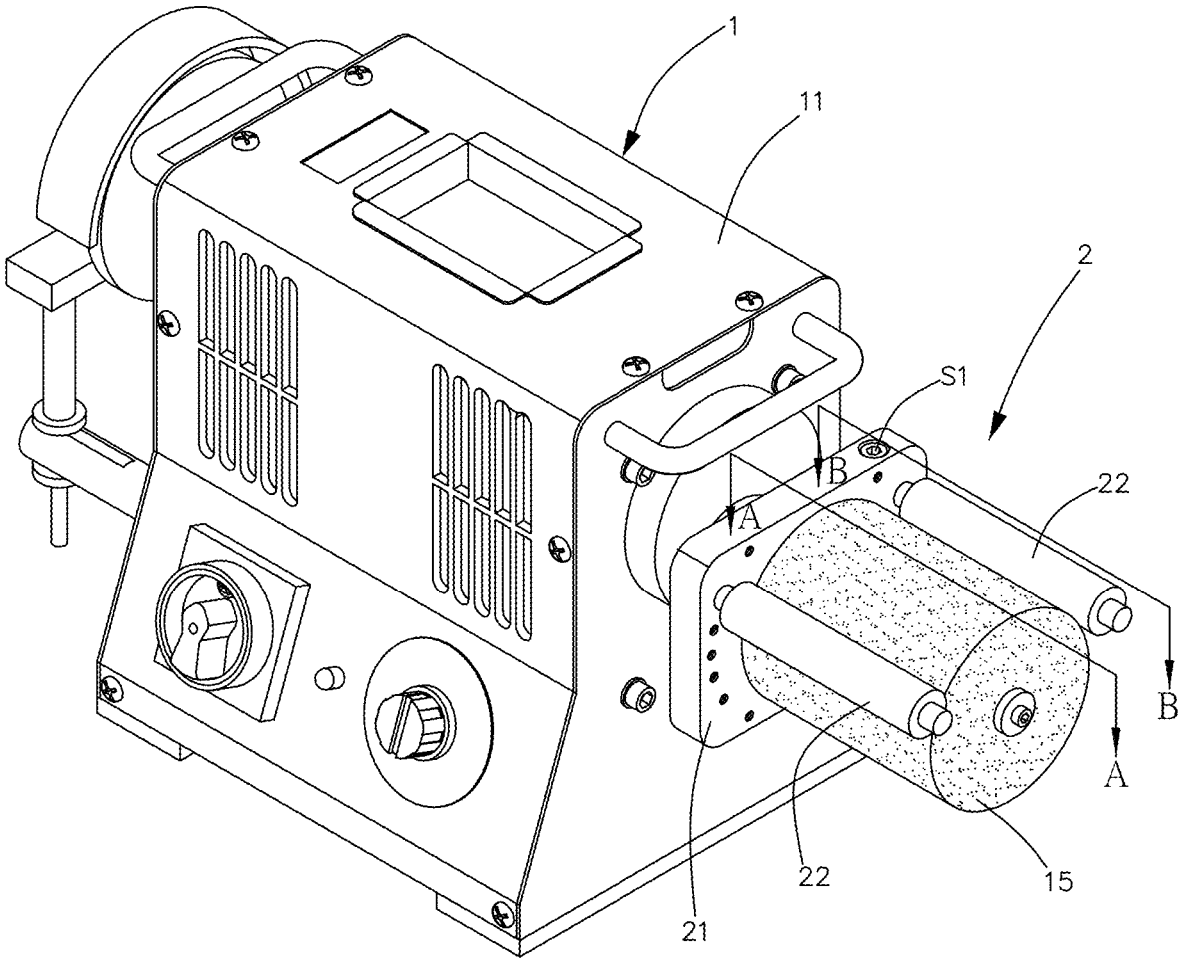
FIG. 2 is a perspective view showing the assembly of the auxiliary positioning device of the pedestal grinder according to the preferred embodiment of the present invention.
Figure 3:
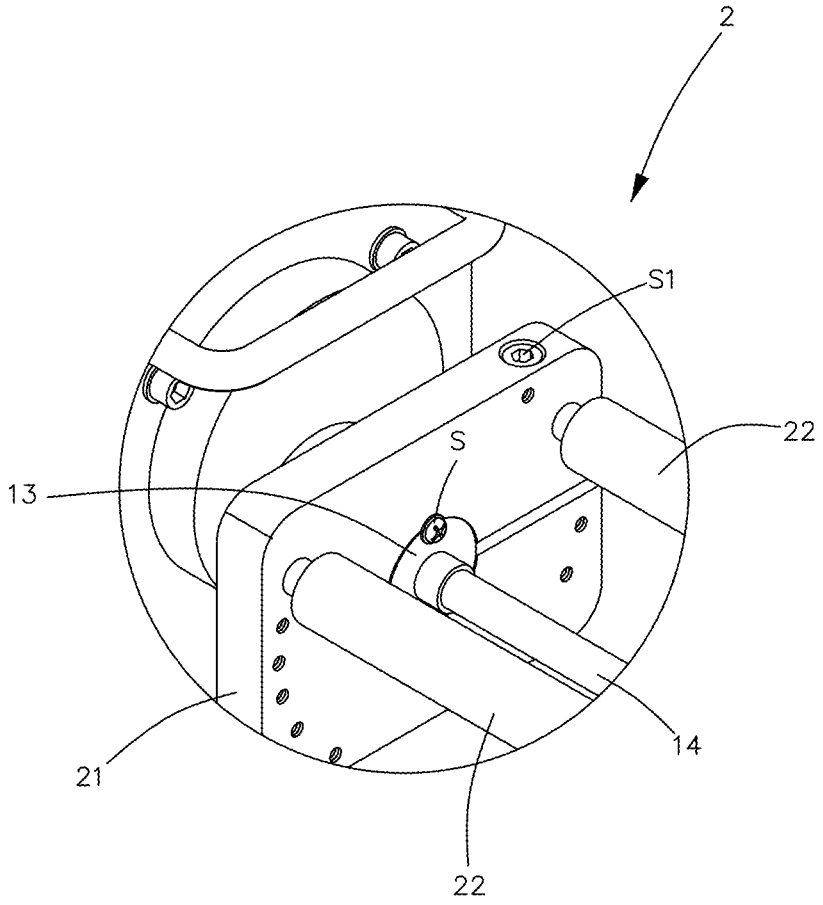
FIG. 3 is a perspective view showing the assembly of a part of the auxiliary positioning device of the pedestal grinder according to the preferred embodiment of the present invention.
Figure 4:
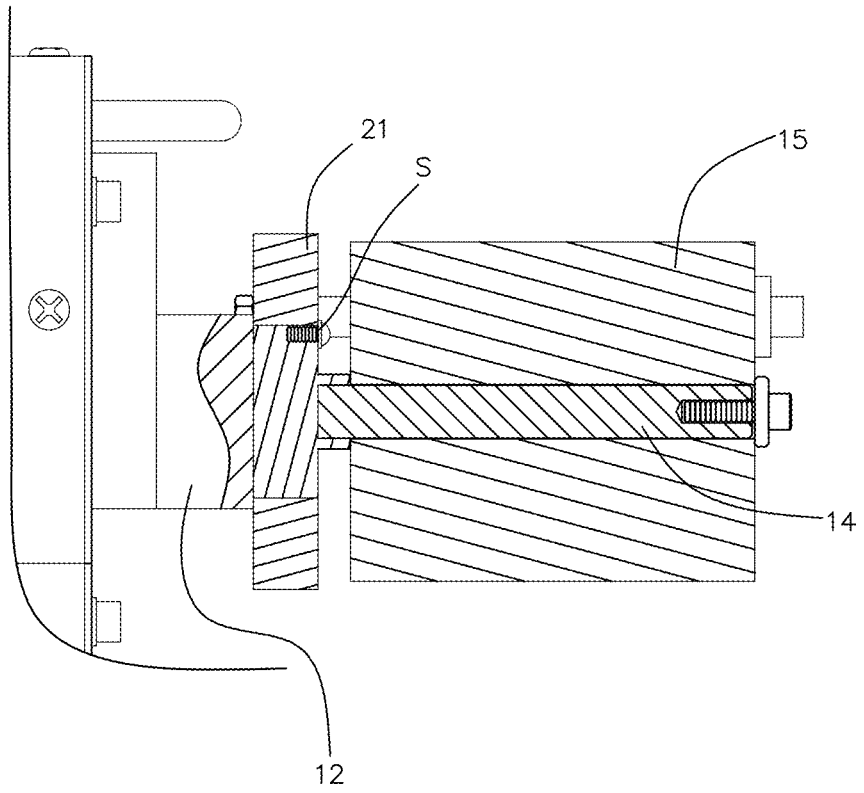
FIG. 4 is a cross sectional view taken along the line A-A of FIG. 2.
Figure 5:
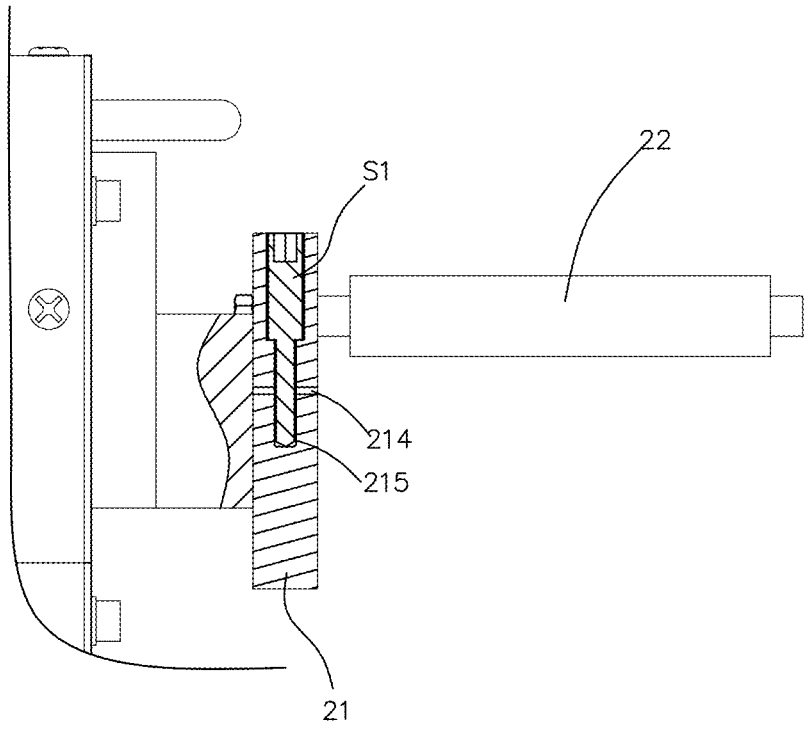
FIG. 5 is a cross sectional view taken along the line B-B of FIG. 2.

With reference to FIGS. 1-8, a pedestal grinder 1 according to a preferred embodiment of the present invention comprising:

a body 11 in which a drive unit (not shown) is fixed, and the drive unit including an output shaft 14 connected on and driven by the drive unit to rotate;

a transmission seat 12 mounted on a side of the body 11 and including a rotatable fixing block 13 integrally extending from a side of the transmission seat 12, the output shaft 14 connected on a center of the rotatable fixing block 13, and multiple grinding units 15 disposed on the output shaft 14 by using a first of multiple screws S, wherein the output shaft 14 rotates to grind a workpiece after being driven by a driving mechanism of a motor, and each of the multiple grinding units 15 is any one of a grinding wheel, an abrasive wheels, and a polishing wheel.

An auxiliary positioning device 2 is secured on the rotatable fixing block 13 of the pedestal grinder 1 and includes a support unit 21 and at least one movable holding unit 22, wherein the support unit 21 is formed in a rectangle shape or a circle shape and is connected on the rotatable fixing block 13 so as to rotate clockwise or counterclockwise along the rotatable fixing block 13, and the support unit 21 has a fitting orifice 211, a locking portion 212, and at least one coupling orifice 213. The fitting orifice 211 is defined on the support unit 21 and corresponds to the rotatable fixing block 13 so that the support unit 21 is fitted on the rotatable fixing block 13 by using the fitting orifice 211. The rotatable fixing block 13 has an aperture defined around a center thereof, a second of the multiple screws S is configured to lock the rotatable fixing block 13 and the support unit 21, and third screws of the multiple screws S are configured to lock the support unit 21 and the at least one movable holding unit 22 via some of the at least one coupling orifice 213, thus positioning the support unit 21.

The locking portion 212 is configured to fix the rotatable fixing block 13 (such as a C retainer), wherein the locking portion 212 has a slot 214 and a locating portion 215, the slot 214 is defined beside a side of the fitting orifice 211, and a fourth of the multiple screws S is inserted through the slot 214 from the locating portion 215 to force the support unit 21 relative to the rotatable fixing block 13, thus adjusting a tilting angle of the support unit 21 relative to the rotatable fixing block 13. Two fifth of the multiple screws S are inserted through the at least one coupling orifice 213 so as to lock the at least one movable holding unit 22, thus positioning the workpiece auxiliarily.

Figure 6:
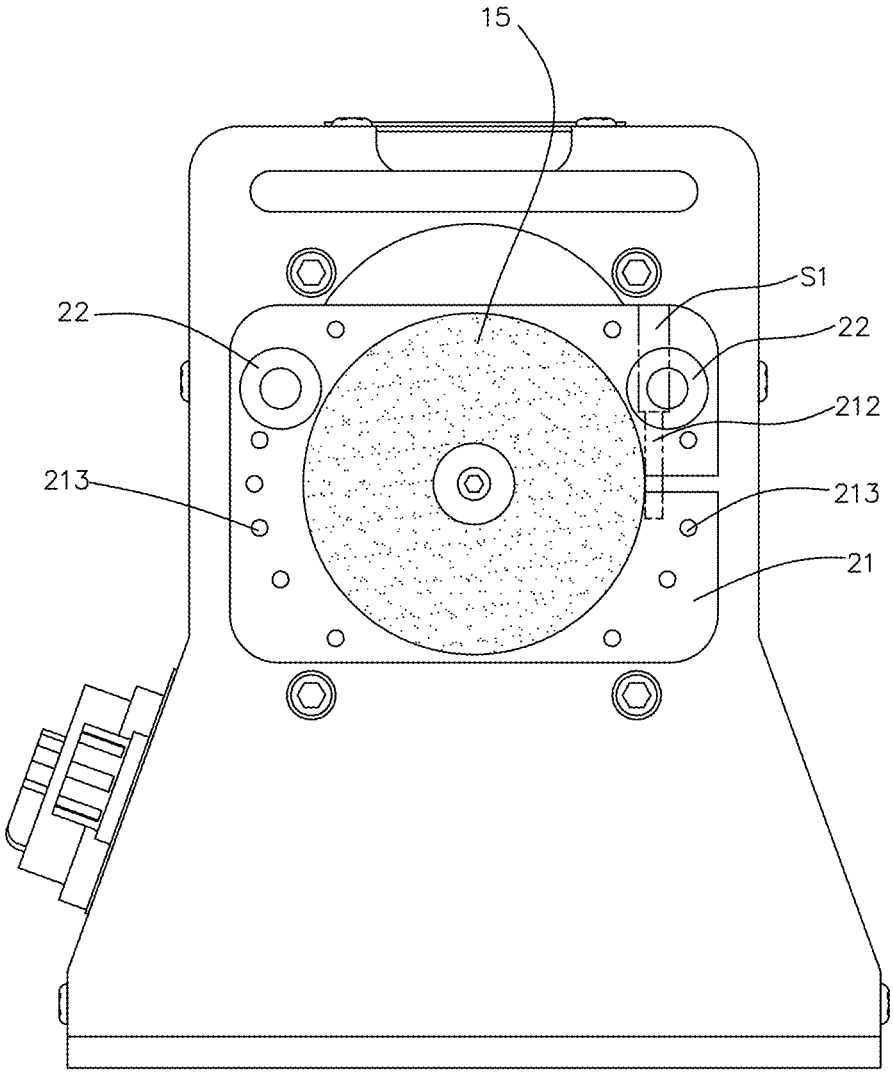
FIG. 6 is a side plan view showing the assembly of the auxiliary positioning device of the pedestal grinder according to the preferred embodiment of the present invention.
Figure 7:
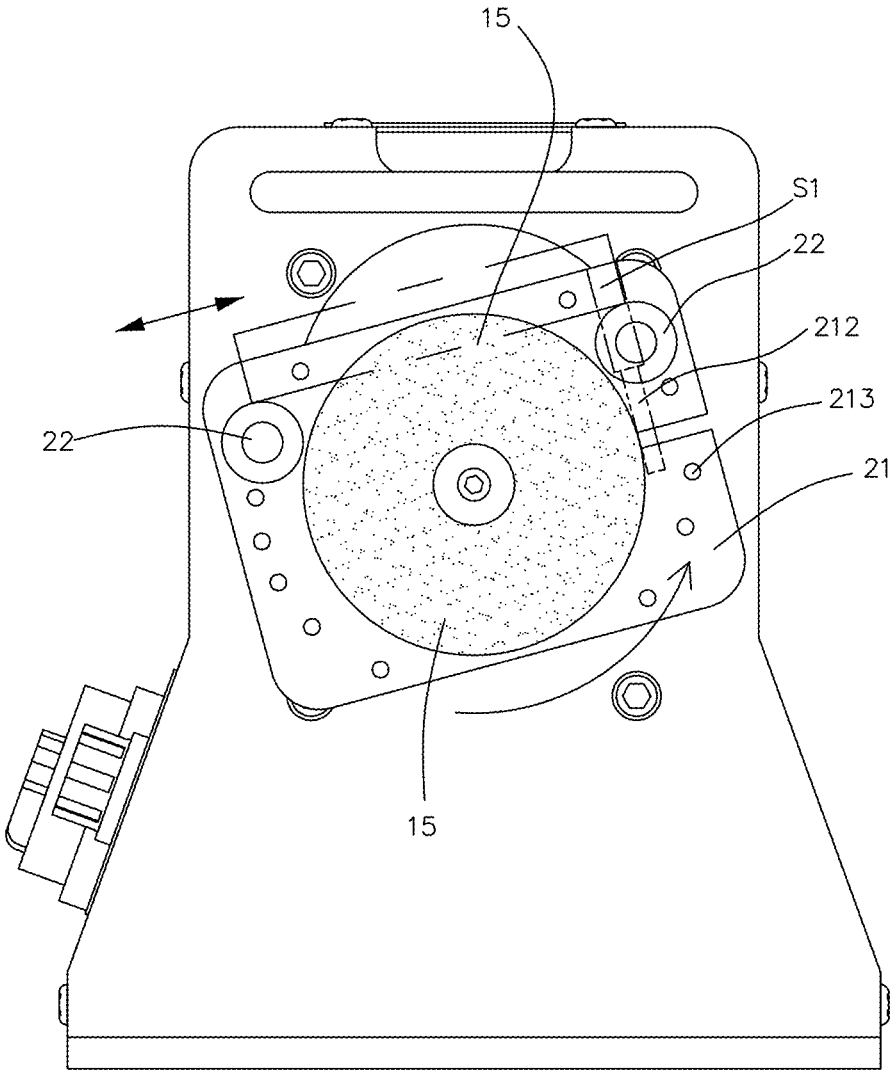
FIG. 7 is a side plan view showing the operation of the auxiliary positioning device of the pedestal grinder according to the preferred embodiment of the present invention.

Thereby, the auxiliary positioning device 2 of the present invention has advantages as follows:

1. Referring to FIGS. 1-6, the auxiliary positioning device 2 is mounted on the pedestal grinder 1, the at least one coupling orifice 213 is defined around the fitting orifice 211 of the support unit 21 so that the at least one movable holding unit 22 is adjustably locked on the support unit 21 to position the workpiece based on a size of the workpiece, and the workpiece abuts against the at least one movable holding unit 22, thus grinding the workpiece by using the multiple grinding units 15. As shown in FIGS. 6-7, the at least one movable holding unit 22 is locked on two of the at least one coupling orifice 213 adjacent to two sides of the support unit 21, such that the workpiece is placed on the at least one movable holding unit 22 and is pushed back and forth by an operator, thus grinding the workpiece.

Figure 8:
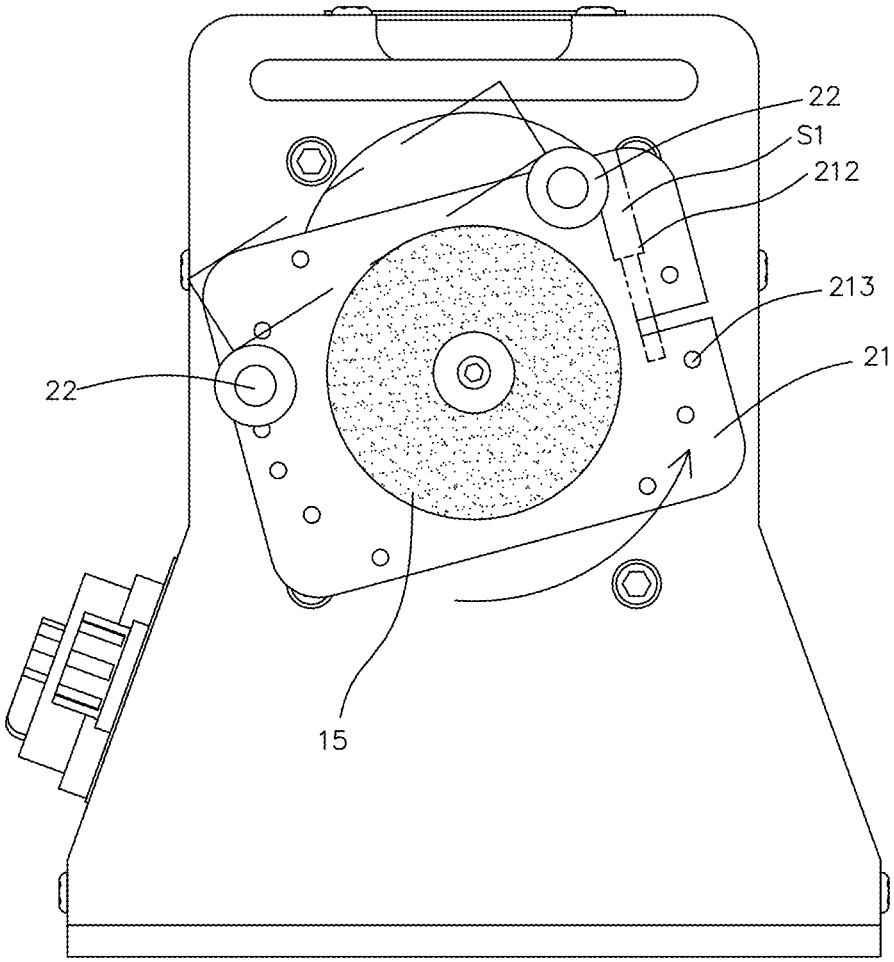
FIG. 8 is another side plan view showing the operation of the auxiliary positioning device of the pedestal grinder according to the preferred embodiment of the present invention.

2. As shown in FIG. 8, the support unit 21 and the at least one movable holding unit 22 are placed obliquely by the operator so as to grind the workpiece into a tilted face, a specific angle, or a specific shape based on a working drawing.

3. In another embodiment, diameters of the at least one movable holding unit 22 are different based on working requirements, thus grinding the workpiece changeably. For example, the workpiece is ground in an arcuate path or in a quadratic grinding path.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention

What is claimed is:

1. An auxiliary positioning device being secured on a pedestal grinder, and the pedestal grinder comprising:

a transmission seat including a rotatable fixing block integrally extending from a side of the transmission seat, an output shaft connected on a center of the rotatable fixing block and driven by a drive unit to rotate, and multiple grinding units disposed on the output shaft by using a first of multiple screws;

the auxiliary positioning device being secured on the rotatable fixing block of the pedestal grinder;

wherein the auxiliary positioning device includes a support unit and at least one movable holding unit, the support unit is connected on the rotatable fixing block so as to rotate along the rotatable fixing block, and the support unit has a fitting orifice, a locking portion, and at least one coupling orifice, wherein the fitting orifice is defined on the support unit and corresponds to the rotatable fixing block;

wherein the locking portion is configured to fix the rotatable fixing block, and the locking portion has a slot and a locating portion, the slot is defined beside a side of the fitting orifice, and a second of multiple screws is inserted through the slot from the locating portion to force the support unit relative to the rotatable fixing block, thus adjusting a tilting angle of the support unit relative to the rotatable fixing block;

wherein the rotatable fixing block has an aperture defined around a center thereof, a third of the multiple screws is configured to lock the rotatable fixing block and the support unit.

2. The auxiliary positioning device as claimed in claim 1, wherein each of the multiple grinding units is any one of a grinding wheel, an abrasive wheels, and a polishing wheel.

3. The auxiliary positioning device as claimed in claim 1, wherein the support unit is formed in a rectangle shape or a circle shape.

4. The auxiliary positioning device as claimed in claim 1, wherein the at least one coupling orifice is defined around the fitting orifice of the support unit.

5. The auxiliary positioning device as claimed in claim 1, wherein the at least one movable holding unit is locked on two of the at least one coupling orifice adjacent to two sides of the support unit.

6. The auxiliary positioning device as claimed in claim 1, wherein two fourth of the multiple screws are inserted through the at least one coupling orifice so as to lock the at least one movable holding unit.

* * * * *